US011255493B2

(12) United States Patent
Xie et al.

(10) Patent No.: US 11,255,493 B2
(45) Date of Patent: Feb. 22, 2022

(54) LIGHT BULB APPARATUS

(71) Applicant: XIAMEN LEEDARSON LIGHTING CO., LTD, Fujian (CN)

(72) Inventors: Fangzhen Xie, Fujian (CN); Honghong Chen, Fujian (CN); Yongjun Bao, Fujian (CN); Liangliang Cao, Fujian (CN); Bin Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/127,353

(22) Filed: Dec. 18, 2020

(65) Prior Publication Data

US 2021/0396361 A1 Dec. 23, 2021

(30) Foreign Application Priority Data

Jun. 23, 2020 (CN) ..... 202021184873.X

(51) Int. Cl.

| | |
|---|---|
| ***F21K 99/00*** | (2016.01) |
| ***F21K 9/68*** | (2016.01) |
| ***F21V 29/77*** | (2015.01) |
| ***F21K 9/237*** | (2016.01) |
| *F21Y 115/10* | (2016.01) |

(52) U.S. Cl.

CPC ..... *F21K 9/68* (2016.08); *F21K 9/237* (2016.08); *F21V 29/77* (2015.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,502,468 | B2 * | 8/2013 | Li | F21V 29/74 315/294 |
| 9,651,240 | B2 * | 5/2017 | Bucklen | F21V 29/773 |
| 2007/0279862 | A1 * | 12/2007 | Li | F21V 29/51 361/692 |
| 2010/0091487 | A1 * | 4/2010 | Shin | F21S 45/47 362/235 |
| 2010/0110691 | A1 * | 5/2010 | Hsu | F21V 29/773 362/294 |
| 2010/0186937 | A1 * | 7/2010 | Liang | F21K 9/233 165/185 |
| 2011/0232886 | A1 * | 9/2011 | Liang | F21V 29/507 165/185 |
| 2012/0273180 | A1 * | 11/2012 | Tseng | F21V 29/773 165/185 |
| 2013/0010465 | A1 * | 1/2013 | Wang | F21V 13/10 362/235 |
| 2013/0027928 | A1 * | 1/2013 | Kang | F21K 9/232 362/235 |
| 2013/0039056 | A1 * | 2/2013 | Cho | F21K 9/68 362/235 |

(Continued)

*Primary Examiner* — Elmito Breval

(74) *Attorney, Agent, or Firm* — Chun-Ming Shih; Lanway IPR Services

(57) ABSTRACT

A light bulb apparatus includes a cap connector, a light source, a heat sink module, a bulb shell and a reflective layer. The cap connector is used for connecting to an external power source. The bulb shell has a bottom part and a neck part. The reflective layer is disposed at the bottom part of the bulb shell for guiding a first light emitted from the LED module on the reflective layer to escape from the neck part of the bulb shell.

19 Claims, 9 Drawing Sheets

(56) References Cited

U.S. PATENT DOCUMENTS

| | | | | |
|---|---|---|---|---|
| 2013/0058098 | A1* | 3/2013 | Kim | F21V 3/02 362/294 |
| 2013/0063945 | A1* | 3/2013 | Wu | F21K 9/20 362/249.02 |
| 2013/0092362 | A1* | 4/2013 | Chen | F21V 29/83 165/185 |
| 2013/0286666 | A1* | 10/2013 | Bakk | F21V 29/503 362/363 |
| 2013/0307399 | A1* | 11/2013 | Kim | F21V 29/777 313/46 |
| 2014/0043815 | A1* | 2/2014 | Chuang | F21K 9/232 362/249.02 |
| 2017/0162547 | A1* | 6/2017 | Bergmann | H01L 33/507 |
| 2018/0180226 | A1* | 6/2018 | Van Bommel | H01L 25/0756 |

* cited by examiner

LIGHT BULB APPARATUS

FIELD

The present invention is related to a light bulb apparatus, and more particularly related to a light bulb apparatus with enhanced heat dissipation.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light bulb devices are widely used in various places. Some light bulb devices are required to work under high temperature environment.

For example, some light bulb devices are required to emit strong light for long time. It is important to solve the problem of heat dissipation.

In addition, it is also important to consider cost and manufacturing complexity. Therefore, it is beneficial to provide an effective design for new light bulb devices.

SUMMARY

In some embodiments, a light bulb apparatus includes a cap connector, a light source, a heat sink module, a bulb shell and a reflective layer.

The cap connector is used for connecting to an external power source. For example, the cap connector is an Edison cap for plugging to a corresponding Edison socket to receive an external power source like 110V/220V alternating current power.

The light source has one or multiple LED modules. These LED modules may include one or multiple LED chips of same type or different types, e.g. different types of LED chips emitting lights of different colors, color temperatures.

The heat sink module has a first end connected to the cap connector and having a second end connected to the light source module.

The bulb shell has a bottom part and a neck part.

The bulb shell encloses the light source. The bulb shell has a bottom end and a top end. The bottom part is at the bottom end of the bulb shell and the top end of the bulb shell is connected to the heat sink module.

The reflective layer is disposed at the bottom part of the bulb shell for guiding a first light emitted from the LED module on the reflective layer to escape from the neck part of the bulb shell.

In some embodiments, the reflective layer has multiple areas with different light passing ratios.

In some embodiments, an area enclosed by the reflective layer allows a second light of the LED module to directly pass through.

In some embodiments, the light source has a light source plate mounted with the LED module.

There is a board reflective layer for reflecting the light to the neck part of the bulb shell.

In some embodiments, the board reflective layer is an independent layer placed upon the light source plate.

In some embodiments, the board reflective layer has a tilt surface with a tilt angle with respect to the light source plate.

In some embodiments, the LED module has a main light output direction.

The main light output direction has a tilt angle with respect to a vertical line extending from the light source plate.

In some embodiments, the heat sink module has an inner tube and a heat sink sleeve.

The heat sink sleeve encloses at least a portion of the inner tube.

The heat sink sleeve has multiple fins protruding above a tubular surface of the heat sink sleeve.

In some embodiments, the heat sink sleeve has an extension wire to fix the light bulb apparatus to an installation platform to prevent the light bulb apparatus falling down from the installation platform.

The extension wire is also used for connecting to a ground disposed on the installation platform.

In some embodiments, the inner tube has a heat sink strip exposed on an exterior surface to engage the heat sink sleeve.

The heat sink strip is thermally connected to the light source.

In some embodiments, a first air passage is disposed on the second end of the heat sink module for guiding a heat dissipation air passing through.

In some embodiments, a second air passage is disposed on the first end of the heat sink module.

The second air passage is connected to the first air passage via an air channel to conduct the heat dissipation air to flow for carrying away heat of the light source.

In some embodiments, multiple protruding structures are disposed along the air channel.

In some embodiments, the first air passage has a first temperature and the second air passage has a second temperature during use of the light source.

The first temperature is different from the second temperature to enhance the heat dissipation air to flow.

In some embodiments, the light bulb apparatus may also include a fan for pushing the heat dissipation air to move along the air channel.

In some embodiments, the LED module is covered with a diffusion lens.

In some embodiments, the reflective layer is a separate unit attached to the bulb shell.

In some embodiments, the bottom part of the bulb shell is a flat surface.

In some embodiments, the reflective layer is rotated to fix to the bulb shell.

In some embodiments, the reflective layer is made of heat dissipation material.

DETAILED DESCRIPTION

Figure 6:
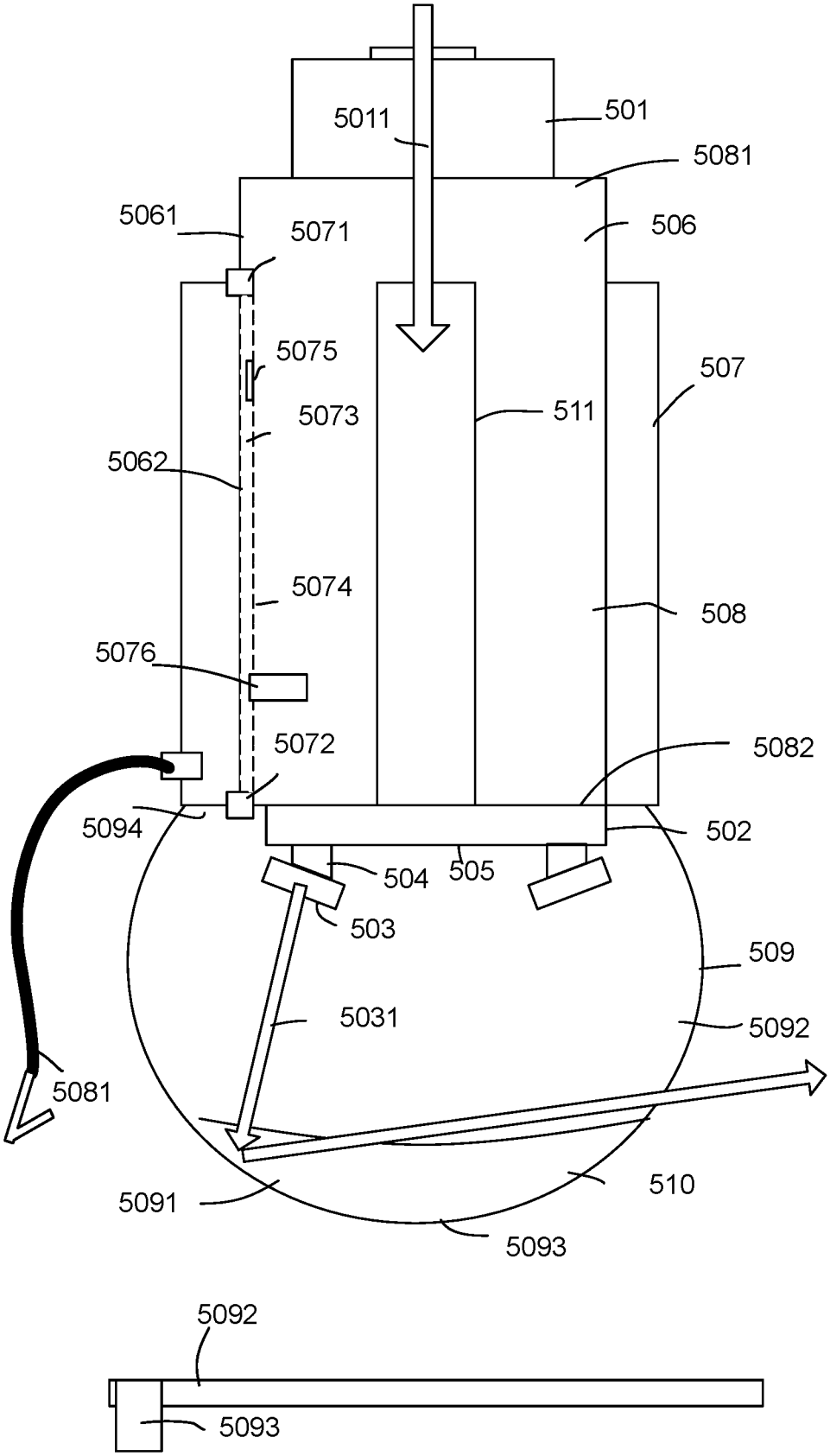
FIG. 6 illustrates an embodiment of another light bulb apparatus.

In FIG. 6, a light bulb apparatus includes a cap connector 501, a light source 502, a heat sink module 508, a bulb shell 509 and a reflective layer 510.

The cap connector 501 is used for connecting to an external power source 5011. For example, the cap connector is an Edison cap for plugging to a corresponding Edison socket to receive an external power source like 110V/220V alternating current power. The external power is transmitted to a driver 511 that converts the alternating current power to a direct current power via rectifying, filtering and other processing. For example, the driver 511 also receives and decodes a wire or wireless command to adjust light output parameters, like color temperatures, colors or intensities of the light source 502.

The light source 502 has one or multiple LED modules 503. These LED modules 503 may include one or multiple LED chips of same type or different types, e.g. different types of LED chips emitting lights of different colors, color temperatures.

The heat sink module 508 has a first end 5081 connected to the cap connector 501 and having a second end 5082 connected to the light source module 502.

The bulb shell 509 has a bottom part 5091 and a neck part 5092. For example, the bottom ball portion is the bottom part 5091 while a surrounding curve surface between the bottom part 5091 and the heat sink module 508 is the neck part 5092.

The bulb shell 509 encloses the light source 502. The bulb shell 509 has a bottom end 5093 and a top end 5094. The bottom part 5091 is at the bottom end 5093 of the bulb shell 509 and the top end 5094 of the bulb shell 509 is connected to the heat sink module 508.

The reflective layer 510 is disposed at the bottom part 5091 of the bulb shell 509 for guiding a first light 5031 emitted from the LED module 503 on the reflective layer 510 to escape from the neck part 5092 of the bulb shell 509.

In some embodiments, the reflective layer has multiple areas with different light passing ratios.

Figure 7:
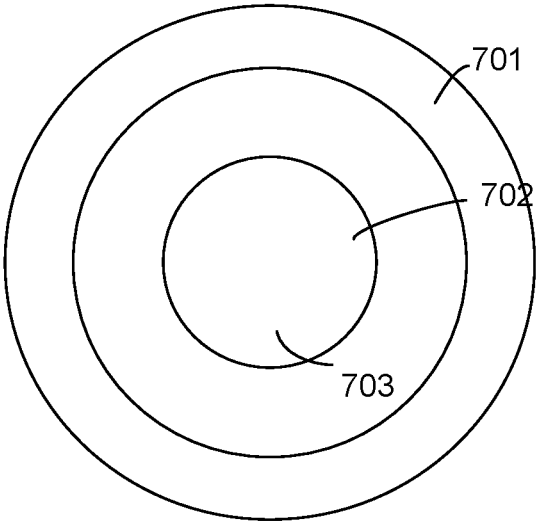
FIG. 7 shows multiple areas of a reflective layer.

Please refer to FIG. 7, which shows a bottom view of an example in which the bottom part of the bulb has several areas 701, 702, 703. These areas 701, 702, 703 are attached with reflective layers with different light passing ratios. For example, the area 703 may have 100% reflective ratio, which means no light is allowed to pass by, while the area 701 may have 50% reflective ratio, which means 50% of light passes through the area 701 and 50% of light is reflected.

In some embodiments, an area enclosed by the reflective layer allows a second light of the LED module to directly pass through.

For example, the area 703 is not covered by the reflective layer and allows light to pass through downwardly.

In FIG. 6, the light source 502 has a light source plate 505 mounted with the LED module 503.

Figure 8:
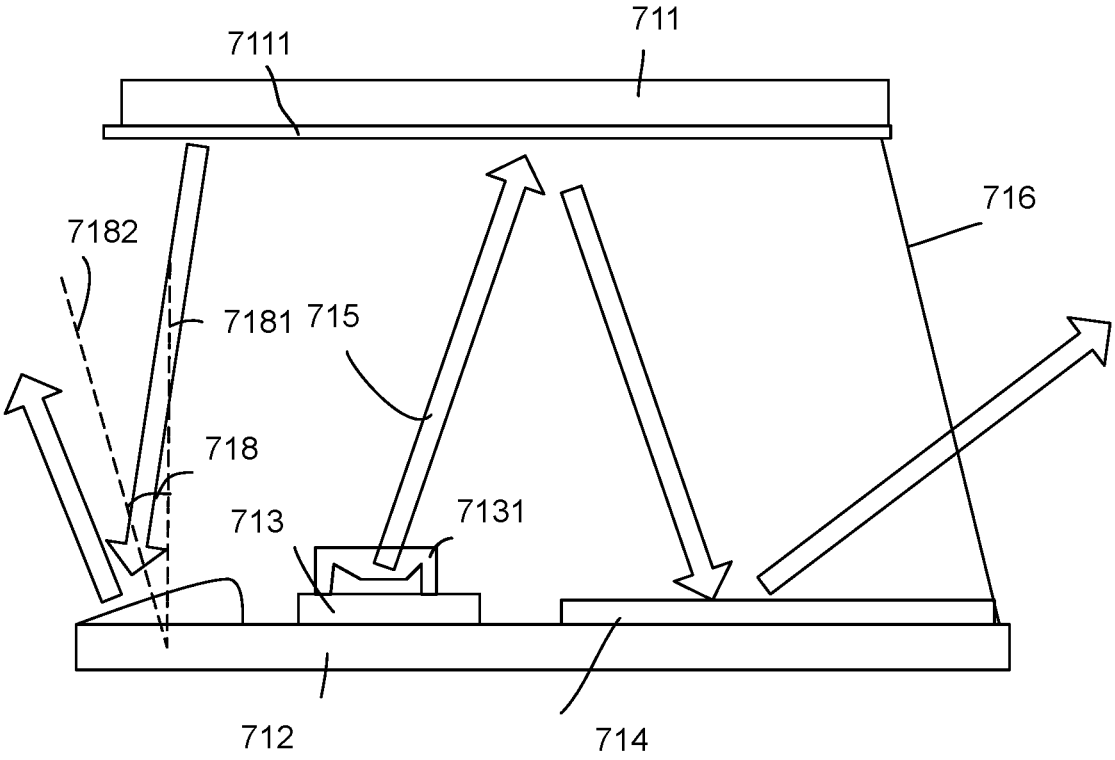
FIG. 8 illustrates a light guiding example.
Figure 9:
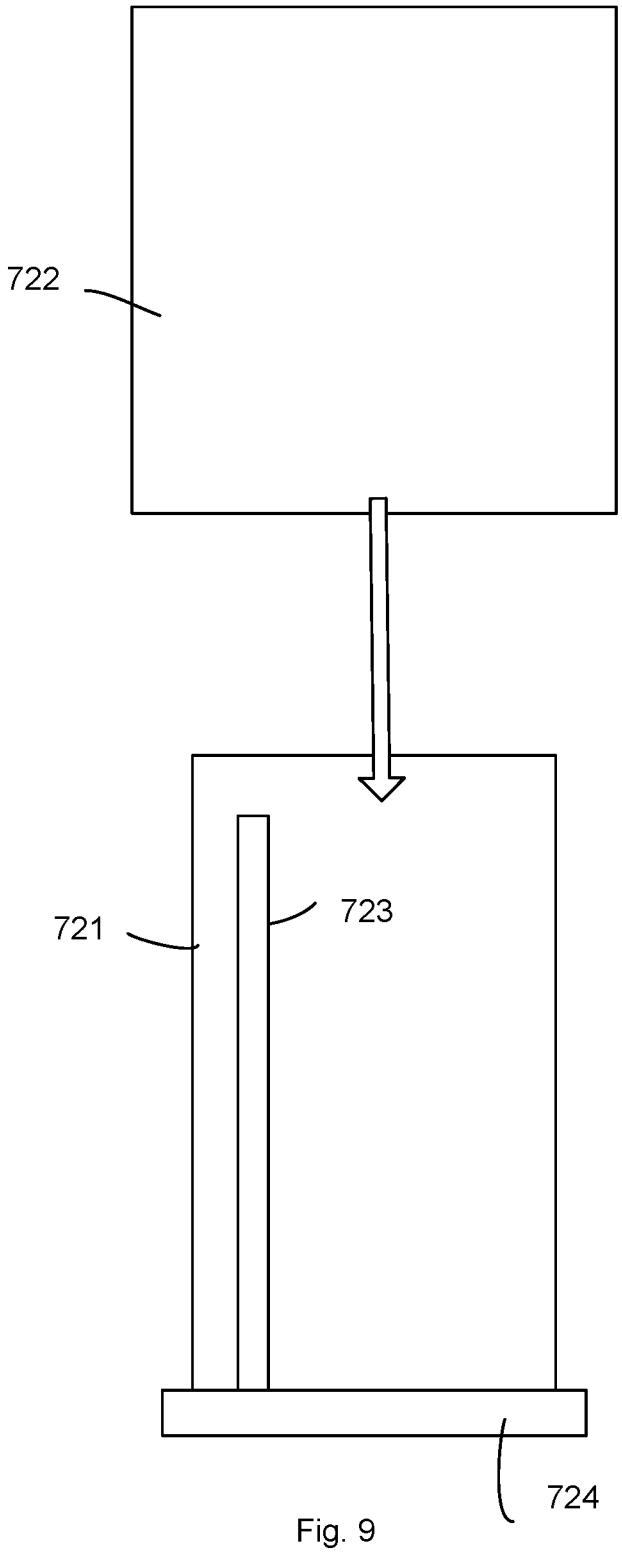
FIG. 9 illustrates assembly of two components in a light bulb apparatus.

Please refer to FIG. 8. There is a board reflective layer 714 mounted a light source plate 712 for reflecting the light 715 emitted by a LED module 713 to the neck part 716 of the bulb shell 7. The light 715 is reflected by the reflective layer on the bottom part 711 of the bulb shell.

In some embodiments, the board reflective layer 714 is an independent layer placed upon the light source plate 712.

In some embodiments, the board reflective layer has a tilt surface with a tilt angle 718 with respect to the light source plate 712.

In some embodiments, the LED module has a main light output direction 7182. The main light output direction 7182 has a tilt angle 718 with respect to a vertical line 7181 extending from the light source plate 712.

In some embodiments, the heat sink module 508 has an inner tube 506 and a heat sink sleeve 507.

The heat sink sleeve 507 encloses at least a portion 5062 of the inner tube 506 and exposes another portion 5061 not covered by the heat sink sleeve 507.

Figure 5:
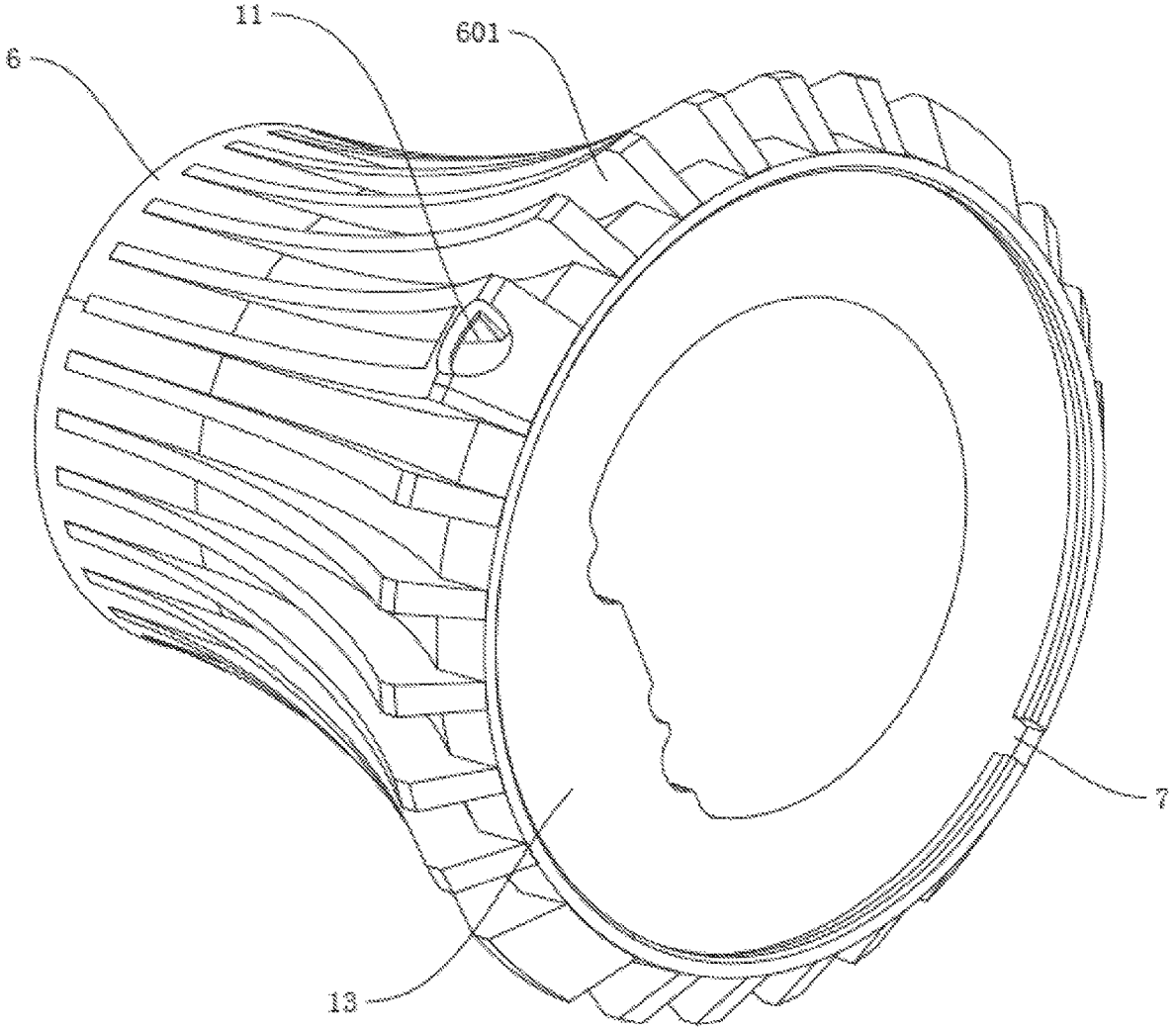
FIG. 5 illustrates a heat sink module example.

The heat sink sleeve has multiple fins protruding above a tubular surface of the heat sink sleeve, e.g. the example illustrated in FIG. 5.

In some embodiments, the heat sink sleeve has an extension wire 5081 to fix the light bulb apparatus to an installation platform 5092 to prevent the light bulb apparatus falling down from the installation platform 5092.

The extension wire 5081 is also used for connecting to a ground 5093 disposed on the installation platform 5092. For example, the extension wire 5081 is mixed with conductive strip connecting to the ground 5093.

In some embodiments, the inner tube 721 has a heat sink strip 723 exposed on an exterior surface to engage the heat sink sleeve 722.

The heat sink strip 723 is thermally connected to the light source 724.

In FIG. 6, a first air passage 5072 is disposed on the second end 5082 of the heat sink module 506 for guiding a heat dissipation air 5073 passing through.

In some embodiments, a second air passage 5071 is disposed on the first end 5081 of the heat sink module.

The second air passage 5071 is connected to the first air passage 5072 via an air channel 5074 to conduct the heat dissipation air 5073 to flow for carrying away heat of the light source 502.

In some embodiments, multiple protruding structures 5075 are disposed along the air channel 5074.

In some embodiments, the first air passage has a first temperature and the second air passage has a second temperature during use of the light source.

The first temperature is different from the second temperature to enhance the heat dissipation air to flow.

In some embodiments, the light bulb apparatus may also include a fan 5076 for pushing the heat dissipation air to move along the air channel 5074.

In FIG. 8, the LED module 713 is covered with a diffusion lens 7131.

In some embodiments, the reflective layer 711 is a separate unit attached to the bulb shell 7111.

In some embodiments, the bottom part of the bulb shell 7111 of the bulb shell is a flat surface.

In some embodiments, the reflective layer is rotated to fix to the bulb shell.

In some embodiments, the reflective layer is made of heat dissipation material.

Figure 1:
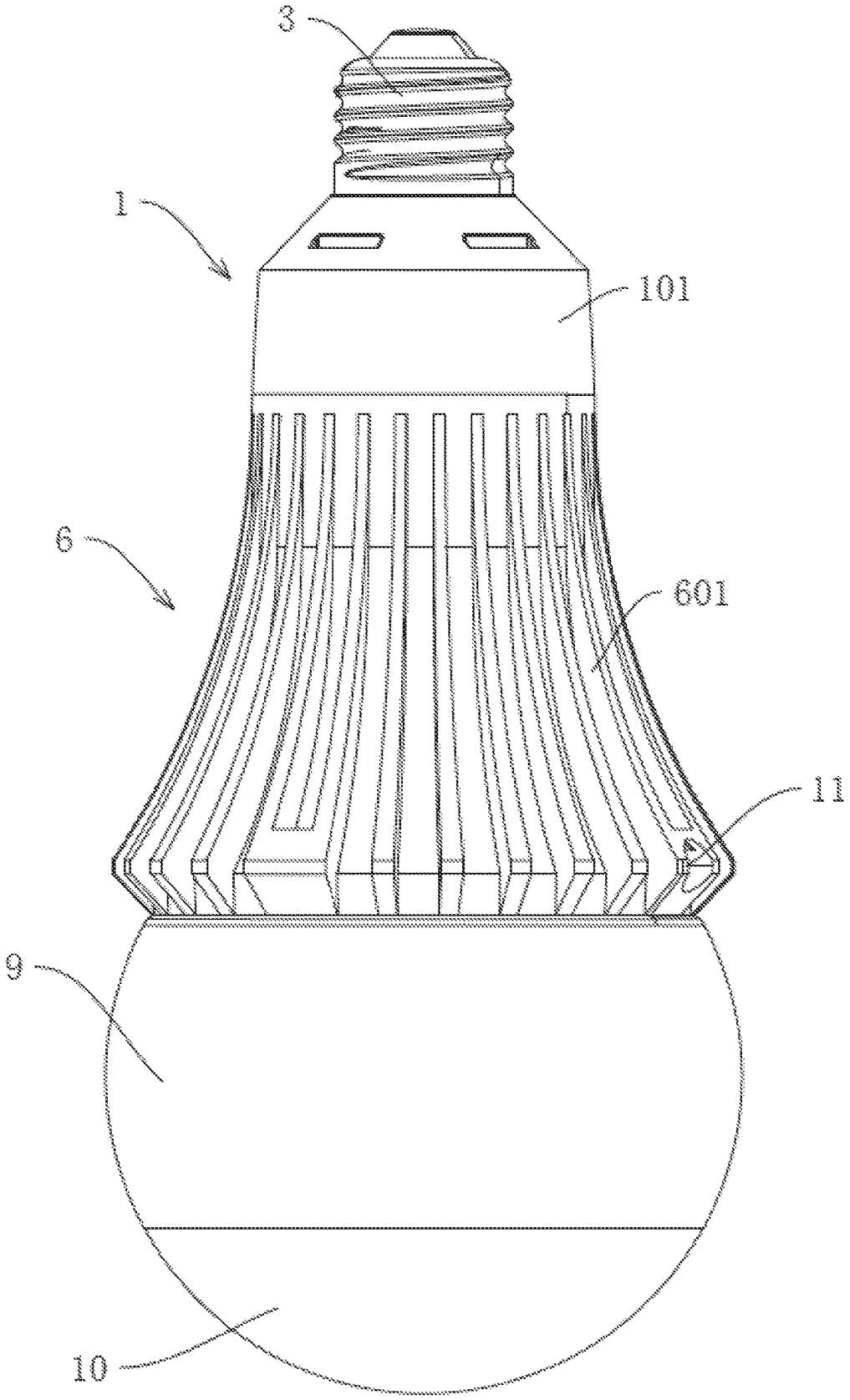
FIG. 1 illustrates a light bulb apparatus embodiment.

Please refer to FIG. 1, which illustrates a light bulb apparatus embodiment. The light bulb apparatus includes a cap connector 3 connected to a heat sink module 1. The heat sink module 1 has an inner tube 101 and a heat sink sleeve 6. The heat sink sleeve 6 has heat dissipation fins 601. There is pull string hole 11 for attaching to a fixing wire. The light bulb shell 9 is attached to heat sink sleeve 6. The reflective layer 10 is attached to the bottom part of the light bulb shell 9.

Figure 2:
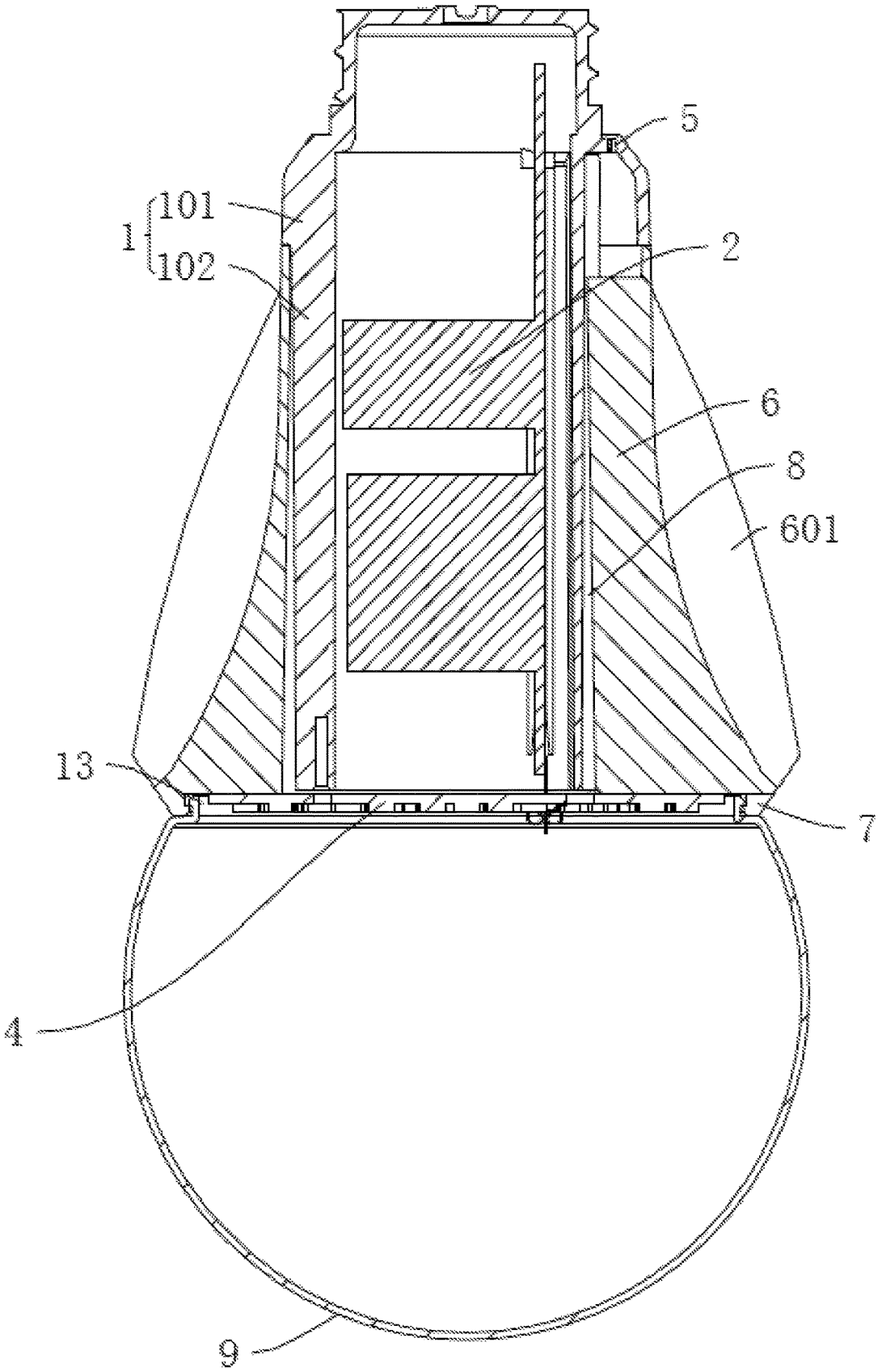
FIG. 2 illustrates a cross-sectional view of the example in FIG. 1.

Please refer to FIG. 2, which shows a cross-sectional view of the example in FIG. 1.

In FIG. 2, the heat sink module 1 has a first part 101 and a second part 102. The first part 101 is not covered by the heat sink sleeve 6. The second part 102 is enclosed by the heat sink sleeve 6. The first air passage 7 and the second air passage 5 connected with an air channel 8 are disposed on two ends of the sink heat module 1.

There is an installation groove 13 for connecting the bulb shell 9 and the heat sink module 1. The light source 4 is attached to the heat sink module 1.

Figure 3:
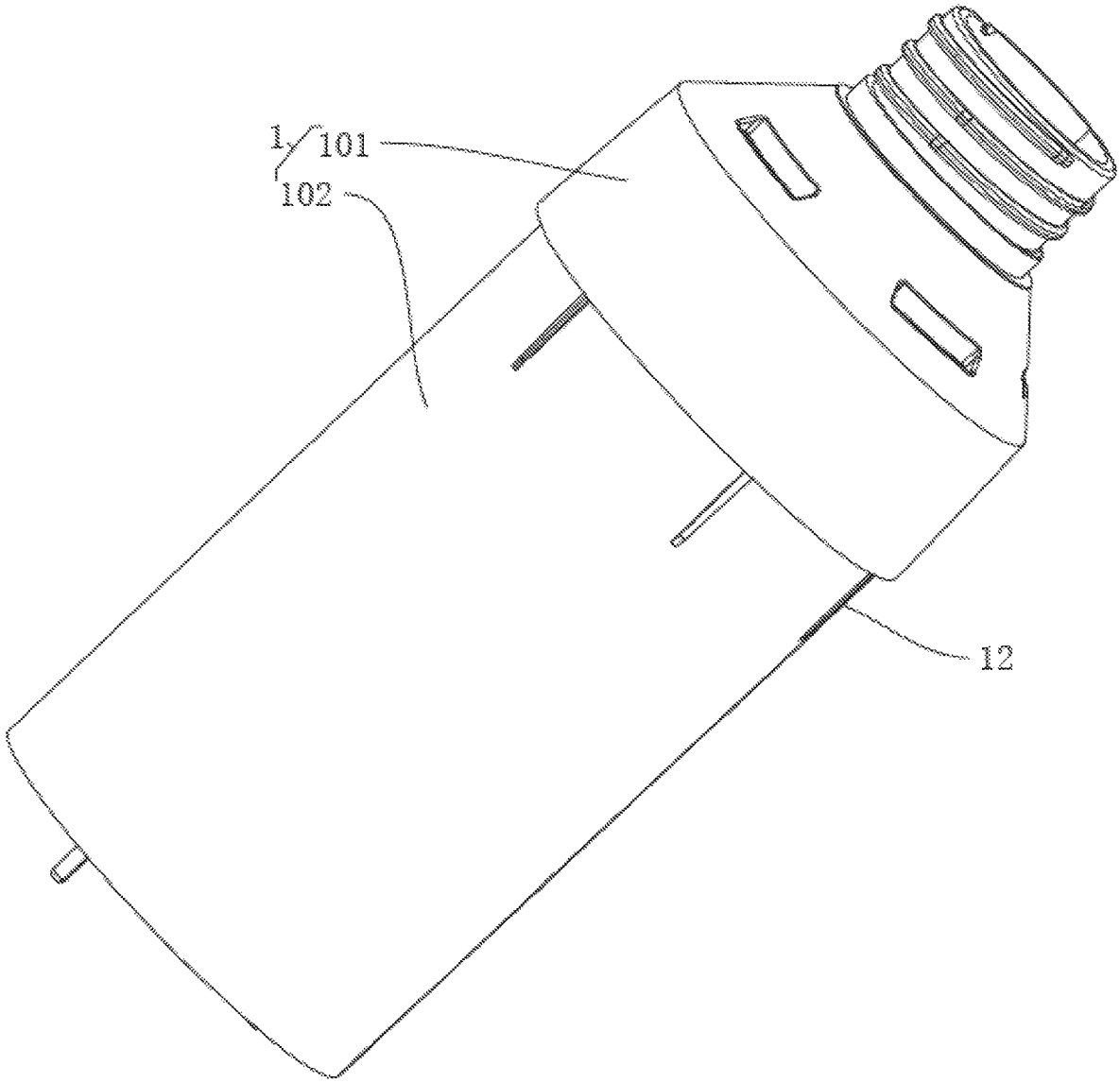
FIG. 3 illustrates a component in the example of FIG. 1.

FIG. 3 shows that the heat sink module has the first part 101 and the second part 102. There is a squeezing line 12 of the second part 102 for inserting the heat sink sleeve.

Figure 4:
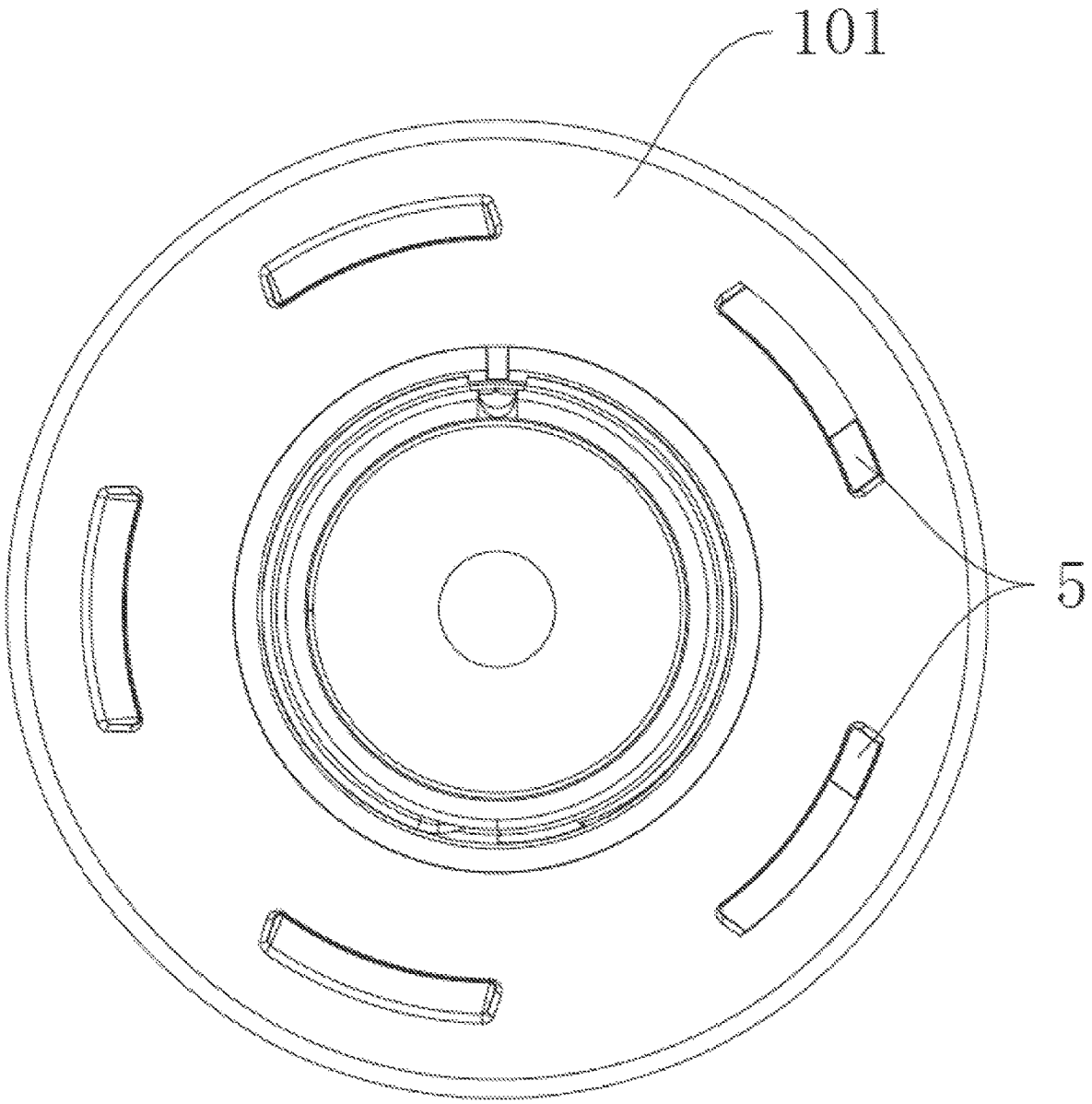
FIG. 4 illustrates an air passage example.

FIG. 4 shows the first part 101 that has a second air passage 5.

FIG. 5 shows heat dissipation fins 601 are disposes on the heat sink sleeve 6. There is a hanging hole 11 on the heat sink sleeve 6. There is an installation slot 13 for inserting the inner tube while leaving the first air passage 7.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising:

a cap connector for connecting to an external power source;

a light source having a LED module;

a heat sink module having a first end connected to the cap connector and having a second end connected to the light source module;

a bulb shell having a bottom part and a neck part, wherein the bulb shell encloses the light source; and a reflective layer disposed at the bottom part of the bulb shell for guiding a first light emitted from the LED module on the reflective layer to escape from the neck part of the bulb shell, wherein the reflective layer has multiple areas with different light passing ratios.

2. The light bulb apparatus of claim 1, wherein an area enclosed by the reflective layer allows a second light of the LED module to directly pass through.

3. The light bulb apparatus of claim 1, wherein the light source has a light source plate mounted with the LED module, there is a board reflective layer for reflecting the light to the neck part of the bulb shell.

4. The light bulb apparatus of claim 3, wherein the board reflective layer is an independent layer placed upon the light source plate.

5. The light bulb apparatus of claim 4, wherein the board reflective layer has a tilt surface with a tilt angle with respect to the light source plate.

6. The light bulb apparatus of claim 3, wherein the LED module has a main light output direction, the main light output direction has a tilt angle with respect to a vertical line extending from the light source plate.

7. The light bulb apparatus of claim 1, wherein the heat sink module has an inner tube and a heat sink sleeve, the heat sink sleeve encloses at least a portion of the inner tube, the heat sink sleeve has multiple fins protruding above a tubular surface of the heat sink sleeve.

8. The light bulb apparatus of claim 7, wherein the heat sink sleeve has an extension wire to fix the light bulb apparatus to an installation platform to prevent the light bulb apparatus falling down from the installation platform, the extension wire is also used for connecting to a ground disposed on the installation platform.

9. The light bulb apparatus of claim 7, wherein the inner tube has a heat sink strip exposed on an exterior surface to engage the heat sink sleeve, the heat sink strip is thermally connected to the light source.

10. The light bulb apparatus of claim 1, wherein a first air passage is disposed on the second end of the heat sink module for guiding a heat dissipation air passing through.

11. The light bulb apparatus of claim 10, wherein a second air passage is disposed on the first end of the heat sink module, the second air passage is connected to the first air passage via an air channel to conduct the heat dissipation air to flow for carrying away heat of the light source.

12. The light bulb apparatus of claim 11, wherein multiple protruding structures are disposed along the air channel.

13. The light bulb apparatus of claim 11, wherein the first air passage has a first temperature and the second air passage has a second temperature during use of the light source, the first temperature is different from the second temperature to enhance the heat dissipation air to flow.

14. The light bulb apparatus of claim 11, further comprising a fan for pushing the heat dissipation air to move along the air channel.

15. The light bulb apparatus of claim 1, wherein the LED module is covered with a diffusion lens.

16. The light bulb apparatus of claim 1, wherein the reflective layer is a separate unit attached to the bulb shell.

17. The light bulb apparatus of claim 16, wherein the bottom part of the bulb shell is a flat surface.

18. The light bulb apparatus of claim 16, wherein the reflective layer is rotated to fix to the bulb shell.

19. The light bulb apparatus of claim 16, wherein the reflective layer is made of heat dissipation material.

* * * * *